US007117874B2

(12) United States Patent
Gubernick

(10) Patent No.: US 7,117,874 B2
(45) Date of Patent: Oct. 10, 2006

(54) CASE FOR PRESENTING AND USING COSMETIC POWDERS

(75) Inventor: Joseph Gubernick, New York, NY (US)

(73) Assignee: E-L Management Corp., New York, NY (US)

( * ) Notice: Subject to any disclaimer, the term of this patent is extended or adjusted under 35 U.S.C. 154(b) by 106 days.

(21) Appl. No.: 09/932,060

(22) Filed: Aug. 17, 2001

(65) Prior Publication Data

US 2003/0034044 A1 Feb. 20, 2003

(51) Int. Cl.
*A45D 33/24* (2006.01)
*A45D 33/26* (2006.01)
*A45D 33/22* (2006.01)

(52) U.S. Cl. ..... 132/294; 132/295

(58) Field of Classification Search ..... 132/294, 132/293, 295–298, 303, 301; 206/581, 823, 206/804

See application file for complete search history.

(56) References Cited

U.S. PATENT DOCUMENTS 2,260,456 A * 10/1941 Johnson ..... 132/200
3,800,034 A 3/1974 Kircher et al. ..... 424/63
3,972,666 A 8/1976 Pandur ..... 425/208
4,337,859 A * 7/1982 Murphy et al. ..... 206/581
4,421,127 A * 12/1983 Geer ..... 132/293
4,555,020 A * 11/1985 Campello et al. ..... 206/235
4,705,051 A 11/1987 Bacon et al. ..... 132/317
4,714,085 A * 12/1987 von Kleinsorgen ..... 132/320
4,826,014 A * 5/1989 Schefer ..... 206/581
4,887,409 A * 12/1989 Israel et al. ..... 53/436
4,887,410 A 12/1989 Gandini ..... 53/436
5,086,791 A 2/1992 Ferrari ..... 132/200
5,713,471 A * 2/1998 Gueret ..... 206/581

* cited by examiner

*Primary Examiner*—John J. Wilson
*Assistant Examiner*—Robyn Doan
(74) *Attorney, Agent, or Firm*—Peter Giancana

(57) ABSTRACT

A case for extruded powders comprising a surface having at least one groove with extruded powders disposed therein. The powders are preferably not all the same color. Preferably, forty percent or more of each extruded powder rises above the surface and preferably, the cross sectional shape of each groove matches the cross sectional shape of that part of the extruded powder that is disposed in the groove. Optional dividers separate the extruded powders so that they do not contact each other. Optional restraints inhibit the powders from coming out of the grooves. Also optional are an outer container into which the surface is disposed and cover to protect the powders when not in use. The case may comprise other cosmetic elements such as an applicator, a mirror or a pan or pressed powder.

16 Claims, 6 Drawing Sheets

CASE FOR PRESENTING AND USING COSMETIC POWDERS

FIELD OF THE INVENTION

The present invention is directed to cosmetic powder cases. Specifically, it is a case for holding extruded cosmetic powders of various colors such that the user can draw an applicator across the different colors to achieve previously unachievable multi-colored cosmetic effects.

BACKGROUND OF THE INVENTION

Compacted cosmetic powders of different colors are frequently packaged in a single container. This provides the user with a customizable cosmetic, because the user may apply to her skin whatever quantity of each color she chooses, thus creating a personal effect. A package with several colors of powder allows the user to experiment until she achieves the look she wants. However, there are practical manufacturing difficulties associated with providing several colors of powder in a single package. Consequently, a container that conveniently holds more than three or four differently colored powders is, to the best of the applicant's knowledge, unknown. Consequently, color shading effects, i.e. amber effects, that may only be achieved with a significantly larger number of colors have been unavailable to the consumer. Here and throughout this specification, the term "ombre effects" refers to the infinite number of gradations of tone that can achieved by mixing in different proportions, a large number of colored powders. Several attempts, have been made to address the various issues associated with providing a large number of powders in a single package. None of these attempts, here summarized, addresses all of the issues as does the present invention.

U.S. Pat. Nos. 4,887,409 and 4,887,410: These multi-colored powder compacts have no dividers between the different colors of powder, giving sharp lines of transition in any desired pattern. The drawbacks of this method include having to fill the pan with loose powder through a specially designed partitioned sleeve, followed by a partial compressing of the powder of each individual color by a specially designed multi-piston assembly, removal of the sleeve and then a second pressing of the complete powder surface by yet another piston. The filling process requires custom equipment and has several steps in which a breakdown in the filling process may occur. The filling process also deals with loose powder. This means that special handling is required to keep the pan and finished compact clean. This is a drawback of the majority of solid powder compacts. The present invention does not require any specially designed filling equipment and filling the case does not deal with loose powder.

U.S. Pat. No. 5,086,791: In this process different loose powders or different colors are introduced in layers into a relatively deep pan. After each layer is filled, the powder is compressed with a piston and the next layer is deposited. Once all the layers have been filled and compressed, the powder is excavated to reveal portions of the multiple layers and to provide a contoured surface in a desired pattern. While the contoured surface is said to be an aesthetic advantage over the usual flat surface associated with pressed powders, this filling process involves several steps, wastes the excavated powder which is a mixture of powders that cannot be separated and requires a deeper than usual pan so that a specially designed compact would be needed. It also has the drawback of filling loose powder and is practically limited to about five different powders or colors of powder. The present invention does not require "excavation," does not waste any product in the filling process, may easily be filled with one to fifty or more colors or powders and may have a contoured surface.

U.S. Pat. No. 4,705,051: This is a powder container for holding at least two colors of loose powder, each in a separate compartment. An adjustable amount of each powder may be introduced into a mixing compartment through a valve. The mixed powder is dispensed on a brush for application. The asserted advantage here is that the user may custom mix the powder to achieve the desired color or effect. Disadvantageously, this device is complex. It requires the use of spring loaded flapper valves, the flow of loose powder and is practically limited in the number of compartments that may be added for differently colored powders. It deals entirely with loose powder which is messier than compacted or extruded powder. Flapper valves and springs become inhibited with powder, deteriorating their function, especially if the loose powder cakes through absorption of moisture. The present invention does not use valves or springs or any moving parts. It does not require the user to pre-mix messy loose powder.

Dry powder sticks by extrusion are known. See for example U.S. Pat. Nos. 3,800,034 and 3,972,666, herein incorporated by reference in their entirety. These patents describe a process for preparing dry powder makeup sticks by extrusion. Extruded power sticks offer an alternative to pressed powders, having advantages in handling and filling. One disadvantage arises because the sticks are generally used by directly drawing the stick over the skin. To this end, the sticks must be formulated to meet conflicting requirements, i.e., possess cohesive strength sufficient to prevent breakage when being drawn over the skin, while being soft enough to yield adequate "pay-off". Pay-off refers to the stick's ability to deposit product as it is drawn over a surface, i.e., the skin. These conflicting requirements place limitations on the chemical composition of the product. Because of their intended method of use, extruded stick powders are not typically applied with a brush and different colors are not typically mixed prior to application. In contrast, the powder case of the present invention, for the first time, permits the use of a brush applicator to mix and apply multiple colors of extruded stick powders. Furthermore, because the sticks are well supported by the case and do not directly contact the skin, they do not have to be formulated to resist breakage to the same degree as the sticks described above. This makes it easier to formulate the sticks to have adequate payoff. Therefore, the present powder case offers more flexibility in the chemical composition of the powder product itself.

OBJECTS OF THE INVENTION

In accordance with the foregoing several objectives of the present invention are:

To provide an inexpensive case for cosmetic powders that makes it easy for the user to achieve sophisticated multi-colored cosmetic effects, here called, ombre effects.

To provide a simple to manufacture case for cosmetic powders that can hold far more colors of powder than has heretofore been available.

To provide a simple to manufacture case for cosmetic powders that can simultaneously hold powders of different chemical characteristics without significant cross contamination.

To provide a method of packing differently colored cosmetic powders into a single case without the need for any post-packing manufacturing, such as pressing and drying.

To provide a case that can hold from one to fifty or more different powders without any alteration of the case or manufacturing process.

To provide a case of cosmetic powders in which the powders form a contoured surface and no wasted powder is generated in the process.

To provide a case for cosmetic powders that is customizable by the user.

To provide a refillable case for cosmetic powders, thus reducing consumer waste.

To allow the use of extruded cosmetic powder chemical compositions not heretofore suitable for consumer use.

SUMMARY OF THE INVENTION

The present invention is a case comprising a surface having at least one groove and extruded powders disposed in some or all of the grooves. Preferably, the powders are not all the same color. A portion of each powder rises above the surface. The case may further comprise one or more dividers that keep adjacent powders in the same groove from contacting each other. The case may also comprise one or more restraints that inhibit the powders from lifting or falling out of the grooves. The grooves and powders need not be all the same shape. Preferably, the portion of the powder that sits in the groove has a shape that is complimentary to the shape of the groove. The case may also comprise an outer container in which the surface is disposed, a cover to protect the powders and an applicator.

DETAILED DESCRIPTION OF THE INVENTION

Figure 1:
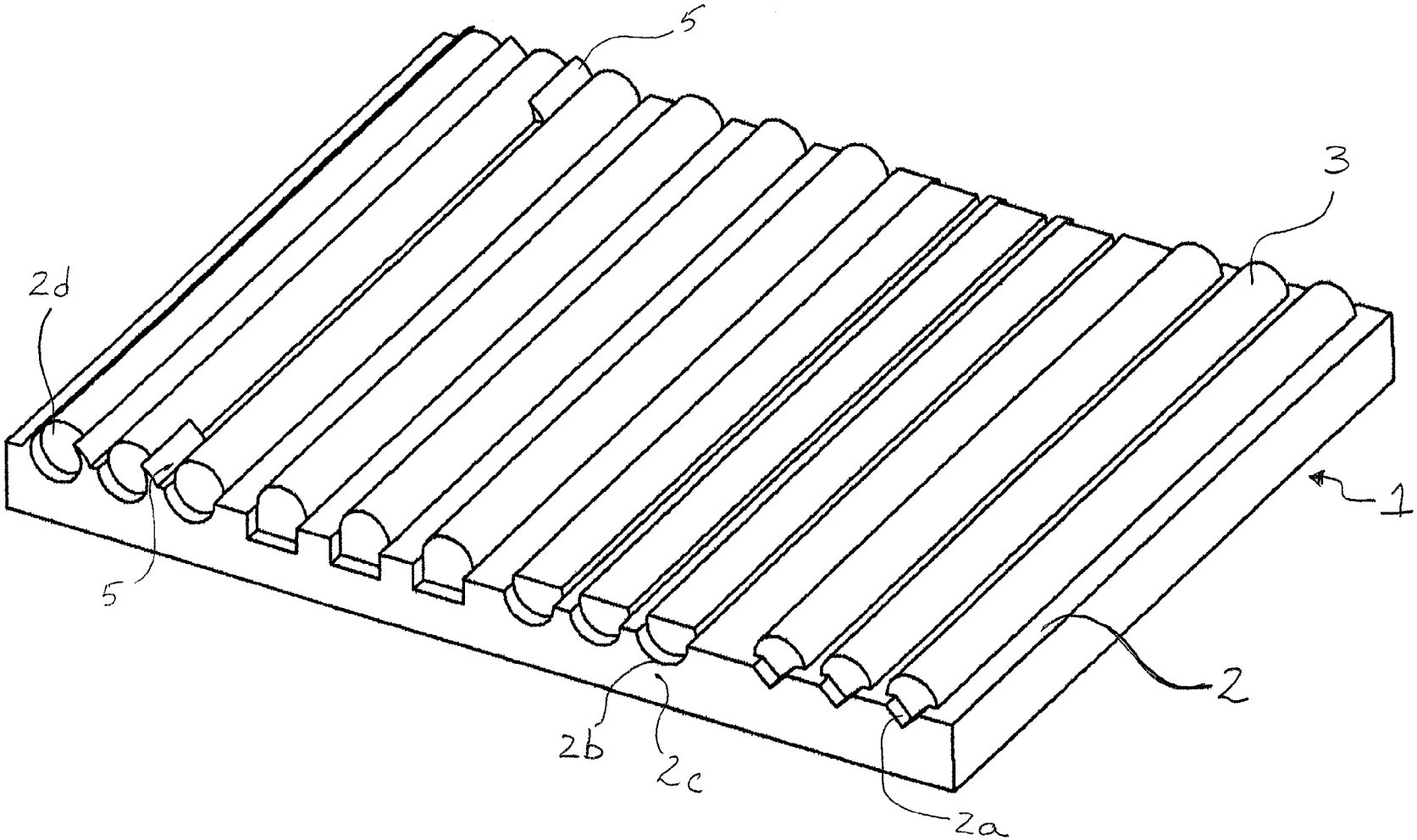
FIG. 1 is a top view of the case with extruded powders of various shapes disposed in the grooves.
Figure 2:
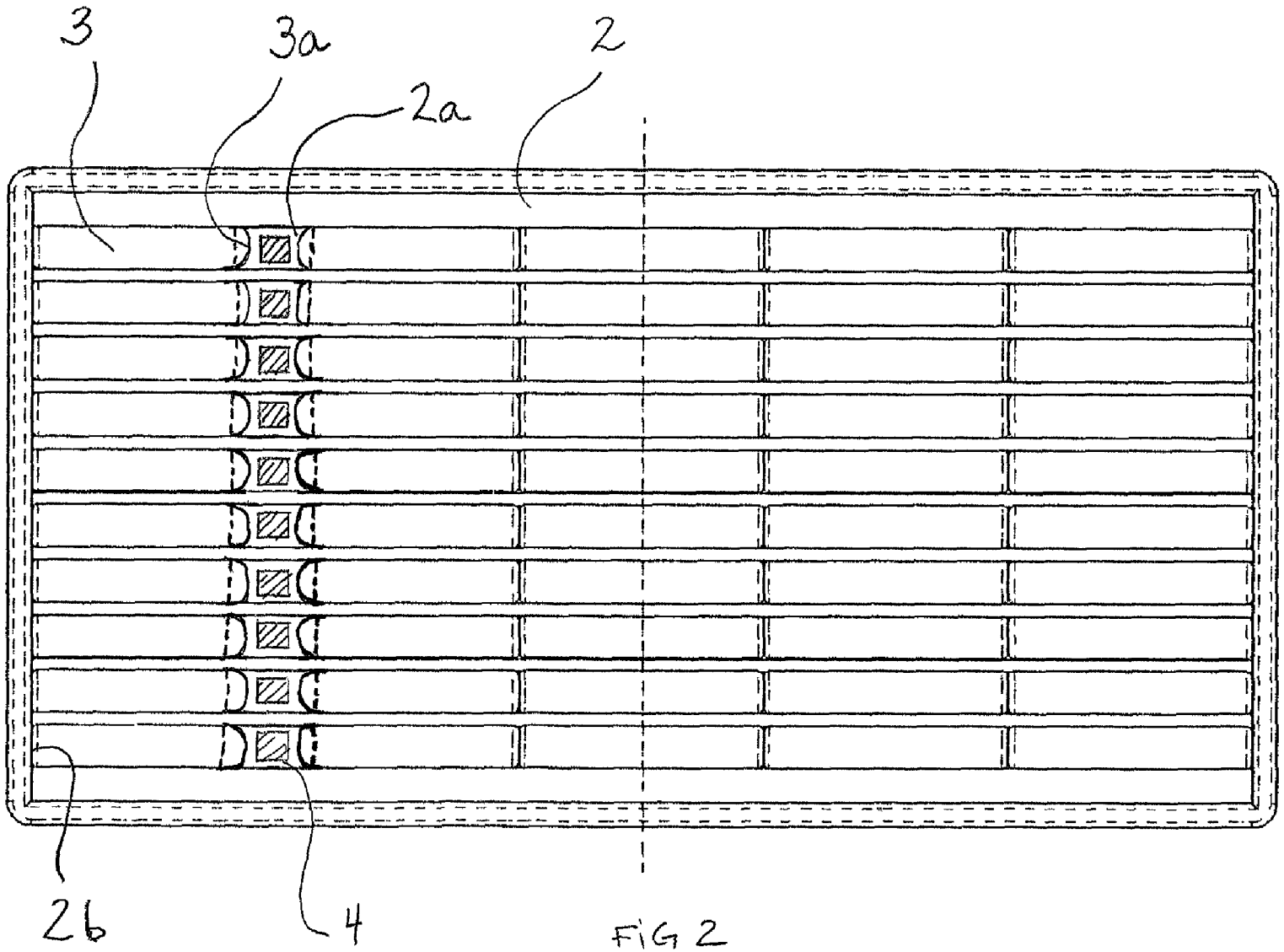
FIG. 2 is a top view showing the powders disposed in the grooves, some of the powders being separated by dividers.

Referring to FIGS. 1 and 2, the present invention is a case (1) comprising a surface (2) having at least one groove (2*a*) and at least one extruded powder (3) disposed in some or all of the grooves. Preferably, the powders are not all the same color. Generally, the powders with which the present invention is concerned are made by mixing dry powder materials, colorants and aqueous binder solution, introducing the mixture into an extruder apparatus to produce an elongated, self-supporting stick and then cutting the stick to desired length and shape. The surface may be plastic, wood or metal. If plastic or metal, then the grooves may be in-molded. The grooves may also be cut out by mechanical means. Preferably, the surface is plastic and the grooves are in-molded. The grooves may be shallow and long, spanning an appreciable length of the surface. This kind of groove is suitable for receiving one or more extruded powder sticks lying on their sides. Alternatively, the grooves may be deep, to receive one or more extruded powder sticks standing on their ends, side-by-side. Alternatively, the grooves may be any width and depth in between, that is suitable for receiving the extruded powders.

Each groove may be opened or closed at its ends (2*b*). If the groove has a closed end, then the closed end of the groove inhibits the extruded powder from sliding out of the groove (see FIG. 2). If the groove has an opened end, then the extruded powder may slide into or out of the groove (see FIG. 1).

One extruded powder stick may take up a whole groove, or several sticks may be positioned in a single groove. If a single groove holds more than one extruded powder, then the case (1) may further comprise one or more dividers (4, see FIG. 2) that are adapted to separate the extruded powders. For example, the dividers may be positioned between the ends (3*a*) of adjacent extruded powders (3). In this case, the dividers limit the lateral movement of the extruded powders and may prevent one powder from contacting a neighboring powder in the same groove. Preferably, the dividers are in-molded with the surface. Alternatively, the dividers may be fastened to the surface by chemical bonding means such as adhesive or by mechanical means such as snap-fitting.

The case (1) may also comprise one or more restraints (see FIG. 1). The restraints inhibit the powders from lifting or falling out of the grooves. Preferably, the restraints are in-molded with the surface. Alternatively, the restraints may be fastened to the surface by chemical bonding means such as adhesive or by mechanical means such as snap-fitting. One embodiment is a flap (5) positioned to contact the extruded powder if the powder is raised out of its groove. In another embodiment, the groove opening (2*d*) at the top of the groove may be slightly smaller than the extruded powder cross section such that the powder is inhibited from coming out of the groove. In this case the powders are filled into the case by forcing the powder through the groove opening at the top of the groove. In this embodiment, the surface is flexible, yielding to the pressure of the extruded powder pressing against it. Alternately, if the groove has an opened end (2*b*), the powder may be inserted into the groove through the opened end.

Figure 3:
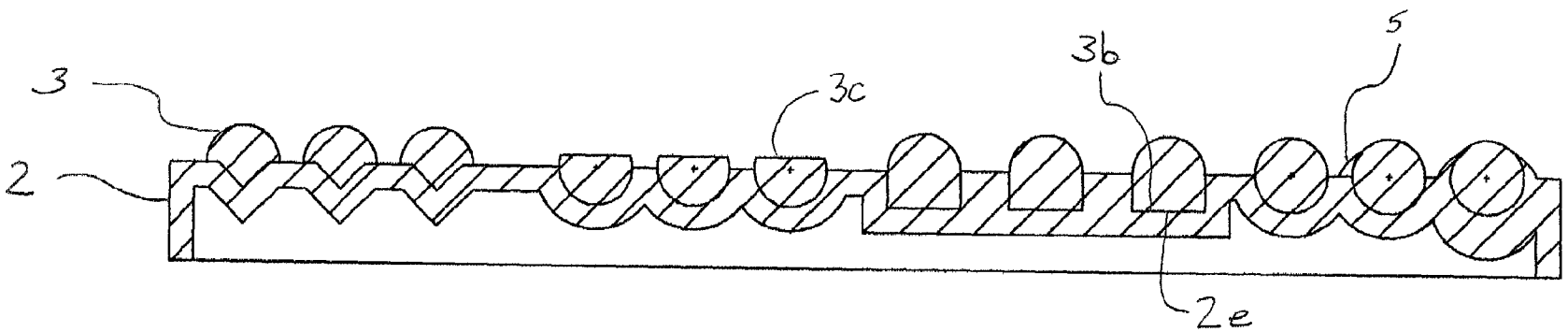
FIG. 3 is a section view showing extruded powders of various shapes disposed in matching grooves.

Ordinarily, a portion of the extruded powders (3) rises above the surface (2) so that the powders form a contoured surface (see FIG. 3). The contoured surface is achieved without wasting any of the powder, as previous manufacturing methods did (see above). The percentage of powder that may conveniently rise above the surface depends on the shape of the powder and whether restraints (5) have been provided. For example, if the extruded powders are cylindrical and if there are no restraints, then the grooves (2*a*) should not be so shallow that the powders roll out of the grooves when a brush drawn across them. In this case, 40–60% of the powder may rise above the surface with 50% being preferred. Alternatively, if restraints are used or if the powder does not roll when a brush is drawn across it because of its shape, then more than 50% of the powder may rise above the surface. In the preferred embodiment, the bottom of the extruded powder has a flat face (3*b*) and the bottom of the groove (2*e*) is also flat to receive the flat face of the powder. Because there is no chance of the powder rolling out of the groove, substantially more than 50% of the powder may rise above the surface. This results in less waste in that little product will be left in the groove that cannot be removed with the applicator. The contoured surface and unlimited number of shapes of the individual powders creates unlimited design possibilities for the overall aesthetic appearance of the case. Alternatively, as shown in FIG. 3 it possible to provide the tops of the extruded powders with a flat face (3*c*), when the desired aesthetic effect calls for this.

Preferably, the cross sectional shape of each groove (2*a*) matches the cross sectional shape of that part of the extruded powder (3) that is disposed in the groove (see FIG. 3). As discussed above, in the preferred embodiment the extruded powder has a flat face and the bottom of the groove is also flat to receive the flat face of the powder. The cross sectional shapes of the grooves may be simple, such as semicircular, triangular, rectangular, pentagonal or hexagonal. Alternatively, the cross sectional shape may be more complex depending on the overall aesthetic needs of the case. Furthermore, the cross sectional shapes of the grooves need not be all the same.

Figure 5:
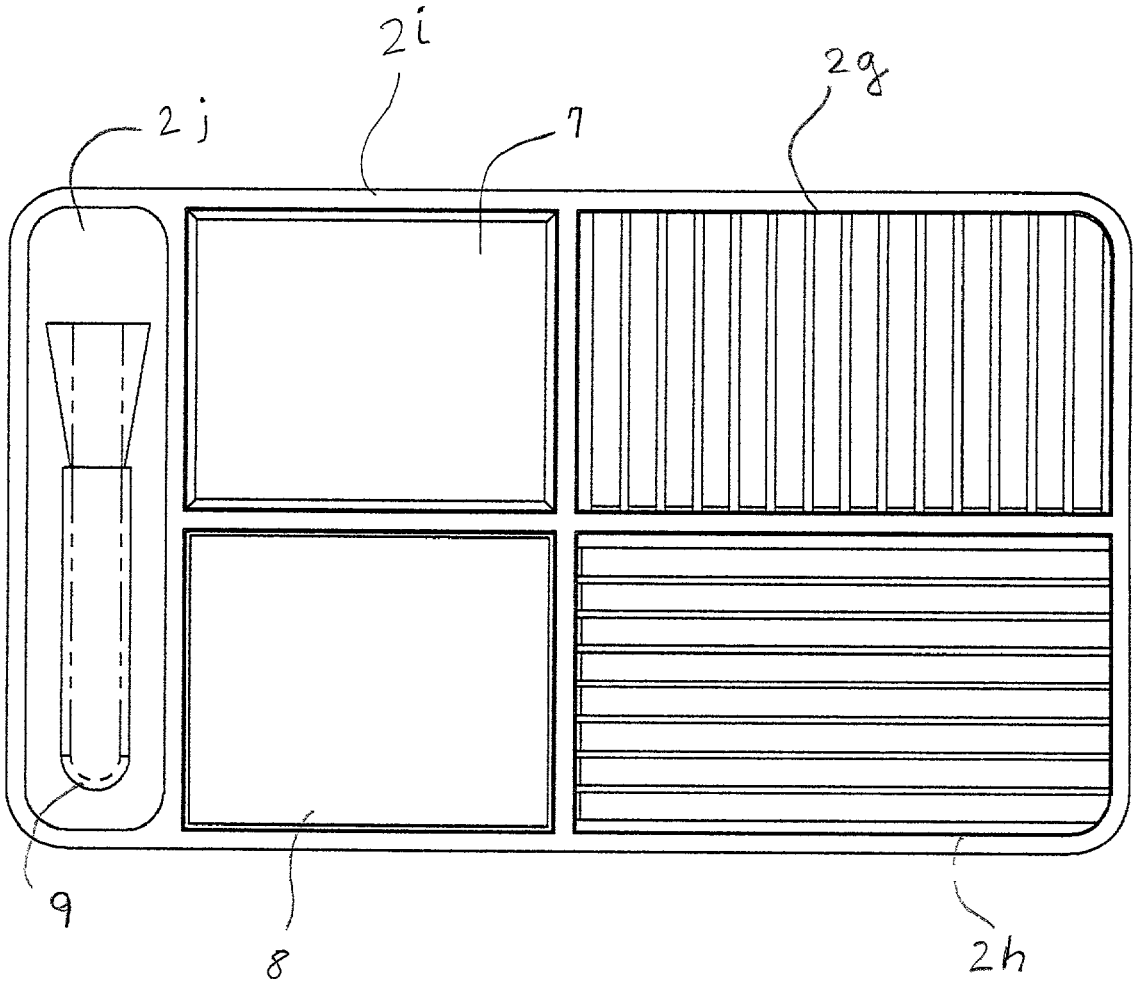
FIG. 5 is a top view of the surface arranged in sections, having an optional applicator, pan and mirror.

The present case may hold one powder formulation in an array of colors or it may hold several formulations having different chemical characteristics that are suitable for different cosmetic applications. For example, in a single case there may be several shades of a blush formulation and several shades of an eyeshadow formulation. The individual formulations may be arranged so that they are in different sections (2*g*,2*h*) of the surface (2) (see FIG. 5). This will ensure that no or little cross contamination occurs from one powder formulation being dragged into another by the brush. The sections may have grooves that run in different directions, thus making the boundary of each section obvious. The surface may comprise a section that has no grooves (2*i*). This section may be suitable for holding other cosmetic elements like a mirror (7), a pan with pressed powder (8), a place (2*j*) to store an applicator (9), etc.

Figure 4:
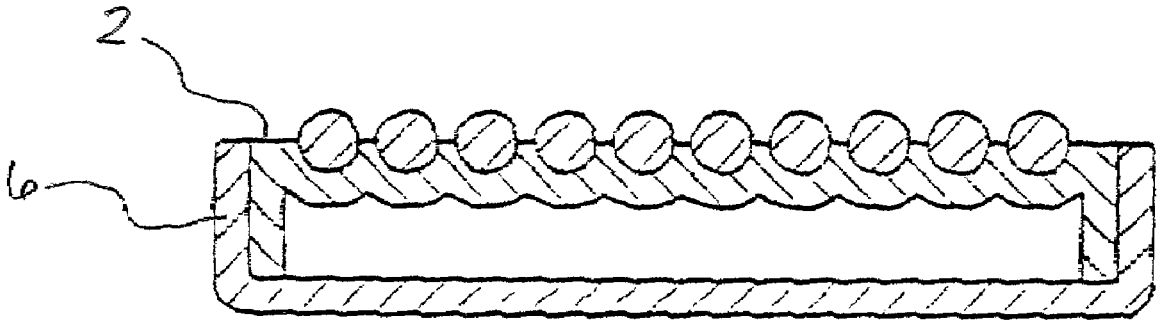
FIG. 4 is a section view showing the optional outer container to hold the surface.

The case (1) may further comprise an outer container (6) into which the surface (2) is disposed (FIG. 4). The outer container provides additional stability to the surface, allowing the surface to be flexible, if that is desired. For example, it would be advantageous to use as little material as possible to mold the surface for cost savings and decreased environmental impact. Also, the outer container may provide a place for storing a cosmetic applicator such as a brush or sponge, a place for holding cosmetic elements like a mirror or pan with pressed powder. Also, the outer container may provide an area that is suitable for decorating, or displaying indicia or labels. also, the outer container may serve as a closed end for one or more grooves, preventing the extruded powders from sliding out of the grooves.

Figure 6:
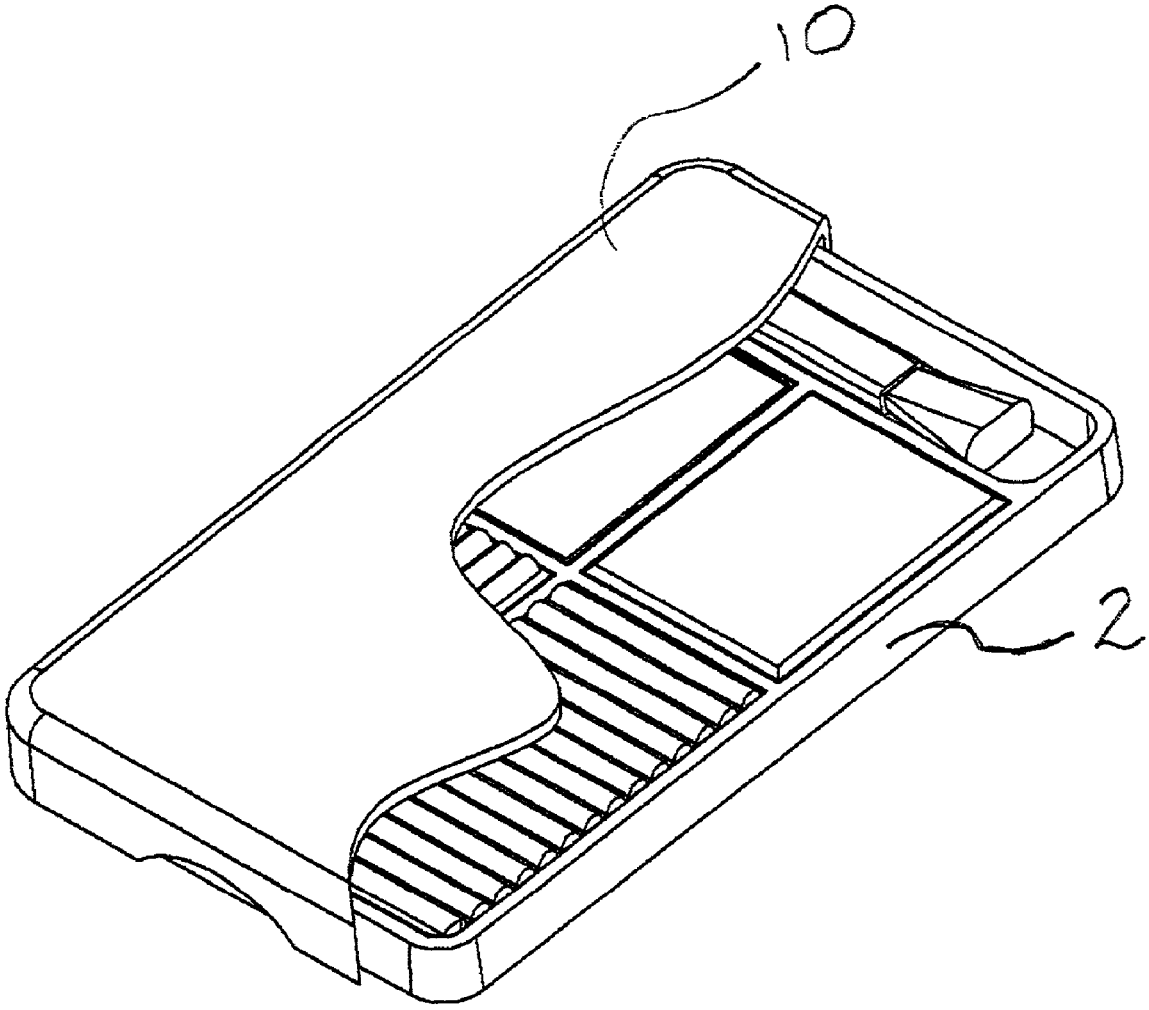
FIG. 6 shows a cover for the case.

The case may also comprise a cover (10, FIG. 6) for protecting the powders when not in use. The cover may be designed to slide onto a portion of the outer container (6) or onto a portion of the surface (2) to give a friction fit. Furthermore, the cover may be hinged to the outer container or to the surface. The cover may house a mirror for convenience. The cover is preferably transparent so that the arrangement and colors of the powders may be seen for their aesthetic impact. Also, the cover may provide an area that is suitable for decorating, or displaying indicia or labels.

In the present invention, the large number of powders greatly expands the ability of the user to customize her makeup for different situations. As an example, a case (1) may comprise from one to ten or more grooves (2*a*) and each groove may hold one to five different powders (3) along its length (see FIG. 2). The number of grooves and powders is only limited by the intended use and aesthetics. The user can brush across one set of powders to obtain one multicolor effect and a different set of powders for a different multicolor effect. The relatively large number of powders over which an applicator may be drawn produces ombre cosmetic effects not achievable with prior art powder cases. Advantageously, the powders may be moved around by the user so that the user may customize the configuration of her powder case. This allows the user to group together those powders that will be used together for creating a specific effect. The user may also replace individual powders that are used up. In this way, the case is reusable, reducing consumer waste. Furthermore, the extruded powders may be applied with a wet or dry brush, which further increases the number of color effects that may be achieved as a result of the present invention.

Furthermore, because the extruded powder sticks of the present invention do not have direct contact with the skin, the powders do not have to be formulated to withstand the pressure associated therewith. This removes some of the formulating restraints associated with conventional extruded powders.

Furthermore, the present invention provides a means for achieving significant visual impact. This is due to the large number of colors that may be advantageously arranged in the case in an unlimited number of variations. Such a case filled with say fifty powders, arranged randomly or for desired visual impact appears as a palette of color that is aesthetically pleasing and not previously known in the cosmetic marketplace. The benefit of this in the crowded beauty marketplace is substantial.

What is claimed is:

1. A case comprising:

a surface having at least one groove;

extruded cosmetic powders disposed in the at least one groove, the powders being not all the same color, wherein forty percent or more of each extruded powder rises above the surface; wherein the cross sectional shape of the at least one groove matches the cross sectional shape of that part of the extruded powder that is disposed in the at least one groove;

dividers that contact one or more ends of the extruded powders;

restraints that inhibit the powders from coming out of the at least one groove;

an outer container into which the surface is disposed;

an applicator; and a cover.

2. The case of claim 1 wherein the extruded powders are not all the same chemical composition.

3. The case of claim 2 wherein the powders of each chemical composition are arranged in sections, each section holding one chemical composition.

4. The case of claim 1 wherein the one groove is in-molded with the surface.

5. The case of claim 1 wherein the at least one groove is cut into the surface.

6. The case of claim 1 wherein one or more of the at least one groove is opened at one or more ends of the groove.

7. The case of claim 1 wherein one or more of the at least one groove is closed at both ends of the groove.

8. The case of claim 1 further comprising openings toward the tops of the at least one groove, wherein the openings are slightly smaller than the extruded powders disposed in the at least one groove such that the powders are inhibited from coming out of the at least one groove.

9. The case of claim 1 wherein the cross sectional shapes of the at least one groove are not all the same.

10. The case of claim 1 wherein the cross sectional shapes of the at least one groove are selected from the group consisting of semicircular, triangular, rectangular, pentagonal and hexagonal.

11. The case of claim 1 wherein the surface comprises a section without grooves, this section holding one or more cosmetic elements.

12. The case of claim 11 wherein the cosmetic elements may be a pan of pressed powder, a mirror or an applicator.

13. The case of claim 1 wherein the outer container comprises a section for holding one or more cosmetic elements.

14. The case of claim 13 wherein the cosmetic elements may be a pan of pressed powder, a mirror or an applicator.

15. The case of claim 1 wherein the cover friction fits onto the outer container.

16. The case of claim 1 wherein the cover is hinged to the outer container.

* * * * *